United States Patent [19]

Charmley

[11] Patent Number: 4,814,114

[45] Date of Patent: Mar. 21, 1989

[54] DIAPHRAGM-CONTROLLED CARBURETOR WITH MANUAL FUEL ENRICHMENT

[75] Inventor: Richard P. Charmley, Caro, Mich.

[73] Assignee: Walbro Corporation, Cass City, Mich.

[21] Appl. No.: 222,261

[22] Filed: Jul. 21, 1988

[51] Int. Cl.[4] ..... F02M 17/04

[52] U.S. Cl. ..... 261/35; 261/DIG. 8; 261/DIG.68

[58] Field of Search ..... 261/35, DIG. 8, DIG. 68

[56] References Cited

U.S. PATENT DOCUMENTS

| | | | |
|---|---|---|---|
| 3,265,050 | 8/1966 | Tuckey | 261/35 |
| 3,441,010 | 4/1969 | Barr et al. | 261/35 |
| 3,743,253 | 7/1973 | Tuckey et al. | 261/DIG. 68 |
| 4,159,012 | 6/1979 | Pizzuto et al. | 261/35 |
| 4,455,266 | 6/1984 | Gerhardy | 261/DIG. 8 |

*Primary Examiner*—Tim Miles

*Attorney, Agent, or Firm*—Barnes, Kisselle, Raisch, Choate, Whittemore & Hulbert

[57] ABSTRACT

A diaphragm-controlled carburetor which includes a diaphragm positioned in a chamber and dividing the chamber into wet and dry chamber sides. A valve is positioned in the wet chamber side, and is responsive to the diaphragm for feeding fuel to fuel jets and thence to a fuel/air passage. The dry chamber side is connected to receive pressure pulses from the engine crankcase through a three-position valve. The valve has orifices selectively interconnected by a rotatable valve disc for feeding pulses at first intensity to provide an enriched fuel/air mixture for starting, at a second lesser intensity to provide a less enriched fuel-air mixture for engine warm-up, and to block pressure pulses from the dry side of the control diaphragm.

10 Claims, 1 Drawing Sheet

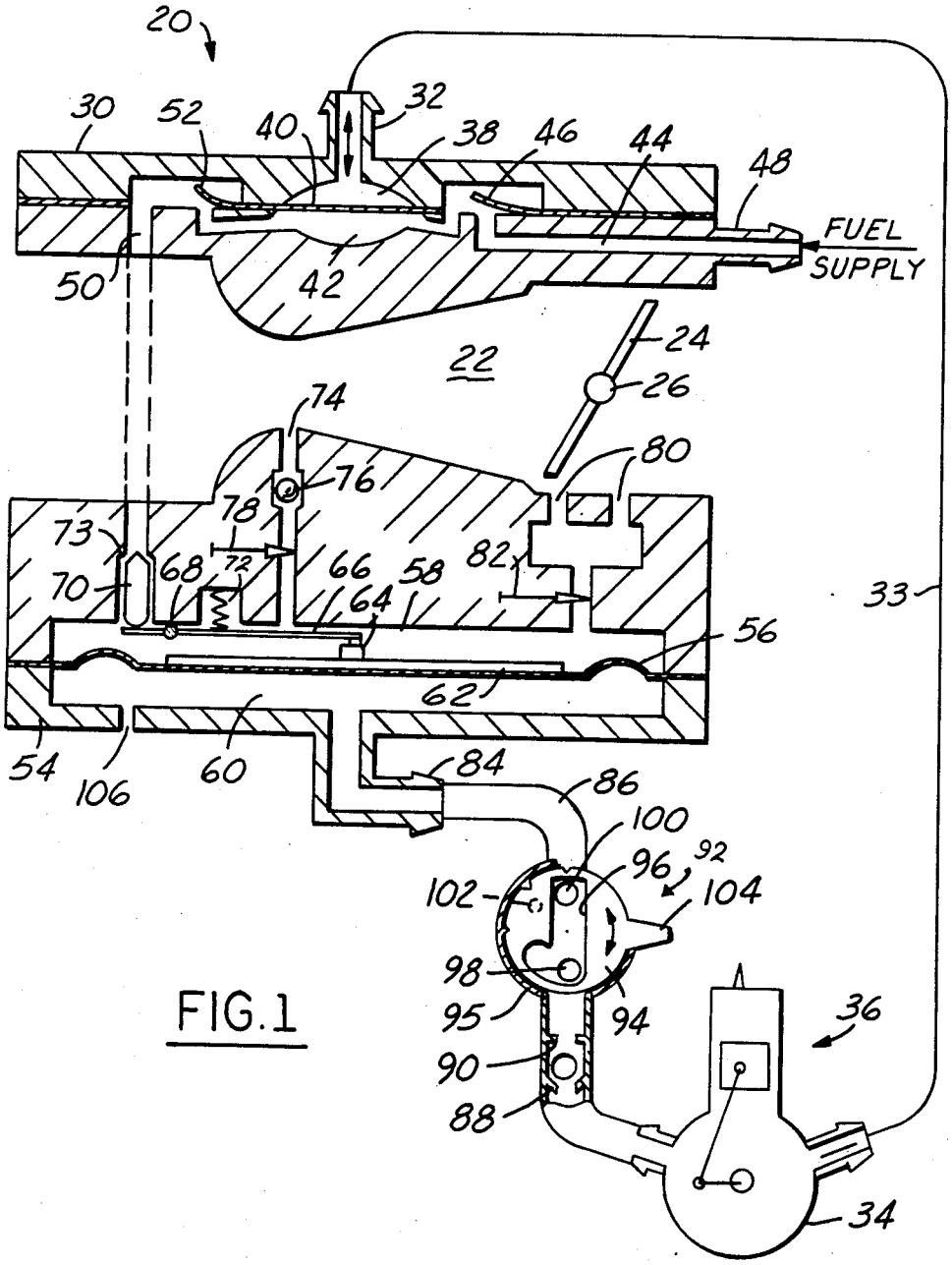
FIG.1
FIG.2
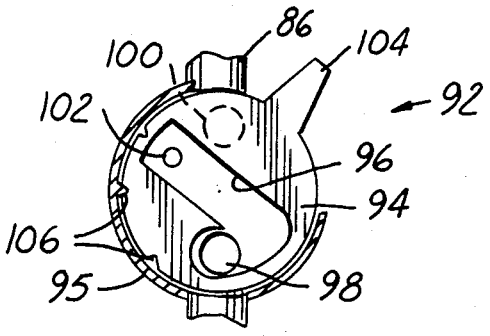
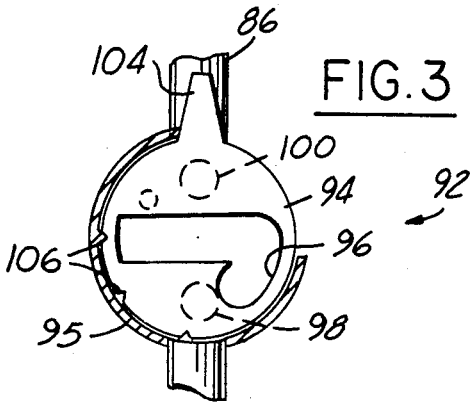
FIG.3

DIAPHRAGM-CONTROLLED CARBURETOR WITH MANUAL FUEL ENRICHMENT

The present invention is directed to diaphragm carburetors for small engines and the like, and more particularly to use of engine crankcase pressure on the carburetor fuel-control diaphragm to enrich the fuel/air mixture during starting and warm-up.

It has heretofore been proposed to direct engine crankcase pressure pulses to the so-called dry side of a carburetor fuel-control diaphragm for controlling or enriching the carburetor fuel/air mixtures. In Japanese Patent No. 1,336,973 (Sept. 11, 1986), for example, the shaft that controls position of the throttle valve in the carburetor air/fuel mixing passage extends into a passage between the dry side of the carburetor fuel-control diaphragm and the engine crankcase. A port that extends diametrically through the shaft feeds crankcase pulses to the dry side of the fuel-control diaphragm as a continuously variable function of throttle position. See also U.S. Pat. Nos. 3,441,010 and 3,743,254. In general, these prior art devices seek to provide fuel enrichment under various running conditions. As a result, the pressure pulses employed are too weak to provide sufficient enrichment on starting, and conventional choke systems are also employed. Such choke systems restrict air passage, and thus cut engine's performance.

A general object of the present invention is to provide a fuel control system for diaphragm carburetors which is more economical to implement than are fuel enrichment systems of similar type heretofore proposed, which is of compact construction and thus may be readily implemented on small engines, particularly two-cycle engines for chain saws and the like, which may be readily controlled by a relatively unskilled operator, and which avoids over-priming and flooding of the engine carburetor.

The invention, together with additional objects, features and advantages thereof, will be best understood from the following description, the appended claims and the accompanying drawings in which:

FIG. 1 is a schematic diagram of a diaphragm carburetor equipped with a manual fuel enrichment system in accordance with a presently preferred embodiment of the invention; and FIGS. 2 and 3 are fragmentary schematic diagrams of the manual control valve in FIG. 1 at the engine warm-up and run positions respectively.

Referring to FIG. 1, a carburetor body 20 has an air and fuel mixing passage 22 controlled by a throttle valve 24 mounted on a control shaft 26. Throttle valve 24 is shown in the fast-idle position in FIG. 1. A top plate 30 has a nipple 32 for coupling by a suitable pressure tube 33 to the crankcase 34 of the engine 36 on which carburetor 20 is mounted. A pulse chamber 38 is formed on the underside of plate 30 in communication with nipple 32 and overlies a pumping diaphragm 40. A pumping chamber 42 is formed in carburetor body 20 beneath diaphragm 40, and is connected by an inlet passage 44 through a check valve 46 to a nipple 48 for coupling to a suitable fuel supply. Chamber 42 is also connected to an outlet passage 50 through a check valve 52.

A bottom plate 54 is mounted on carburetor body 20 and forms a chamber that is divided by a diaphragm 56 into an upper or wet chamber side 58 and a lower or dry chamber side 60. A disc 62 is mounted on diaphragm 56 and has a central button 64 which engages a lever 66 pivoted at 68 to the carburetor body within wet side 58. The opposing or button-remote end of lever 66 engages a valve element 70. A coil spring 72 engages lever 66 and normally urges valve element 70 against a valve seat 73 so as to close communication between fuel outlet passage 50 and wet chamber side 58. A main fuel jet 74 extends from wet chamber side 58 to fuel/air passage 22, and has a check valve 76 and an adjustment needle 78 for controlling passage of fuel therethrough. A pair of idle jets 80 communicate with wet chamber side 58 under control of an adjustment needle 82. Dry side chamber 60 is also vented to atmosphere through the passage 106.

To the extent thus far described, carburetor 20 is of generally conventional construction. Pressure pulses from engine crankcase 34 cooperate with diaphragm 40 to pump fuel through passage 50. When fuel pressure exceeds the pressure on valve element 70 exerted by spring 72 and lever 66, fuel is delivered to chamber 58 and thence through jets 74, 80 to passage 22. Needles 78, 82 adjust fuel flow quantity in the usual and well-known manners.

In accordance with the present invention, dry side chamber 60 is open to an inlet fitting 84 connected by a pulse passage 86 to the crankcase 34 of engine 36. A ball-type check valve 88 is positioned in passage 86 for rectifying pressure pulses from crankcase 34. An orifice 90 is positioned in passage 86 on the carburetor or upstream side of check valve 88 for modulating intensity of crankcase pressure pulses. A three-position manual valve 92 is positioned in passage 86 upstream of orifice 90. Valve 92 includes a flat disc-shaped valve element 94 that is rotatable about its central axis within a surround valve housing 95. Valve disc 94 has a J-shaped slot 96 that selectively connects an inlet orifice 98 to a first outlet orifice 100 in the valve position illustrated in FIG. 1, to a second outlet orifice 102 in the valve position illustrated in FIG. 2, and blocks communication between inlet orifice 98 and either of the outlet orifice 100, 102 in the valve position illustrated in FIG. 3. An ear 104 projects radially outwardly from disc 94 to assist rotation of the valve disc between the three valve positions. Detents 106 or the like may be provided for predetermining the three discrete positions of disc 94.

Outlet orifice 100 is sized so that, in the valve position illustrated in FIG. 1, pressure pulses from engine crankcase 34 operate on control diaphragm 56 so as to feed fuel through jets 80 to provide an enriched fuel/air mixture in passage 22. Such enriched fuel/air mixture assists starting of the engine when the engine is cold. Orifice 102 is sized to provide lower intensity pulses from engine crankcase 34, and thereby to enrich the fuel/air mixture, but at a lesser enrichment level than when inlet orifice 98 communicates with outlet orifice 100.

In operation to start a cold engine, valve 92 is placed in the position of FIG. 1, so that pressure pulses from crankcase 34 provide an enriched fuel/air mixture. After the engine has started, such fuel/air mixture will over-enriched, and the engine will be begin to die. At this point, valve 92 is moved to the position of FIG. 2 at which the enrichment level is decreased, and the engine is allowed to warm up at such lower but still enhanced enrichment level. As the engine warms up, the fuel/air mixture again will be over-enriched, and the engine will again begin to die. At this point, valve 92 is moved to the position of FIG. 3 in which crankcase pulses are blocked from carburetor dry-side chamber 60 and carburetor operation proceeds in the conventional manner. It will be appreciated that, in accordance with the present invention, in the event that the engine is allowed to die from an over-enriched fuel/air mixture, the engine may be immediately restarted without fear of flooding as might be the case with manual or automatic priming systems of the prior art.

The selective enrichment valve 92 provided by the present invention may be readily mounted at any desirable position on the engine. Discrete definition of each of the three valve positions (start, warm-up and run) reduces any tendency for an operator to mis-set the carburetor. The valve-operated enrichment system of the present invention does not affect normal running of the engine as do the prior art devices discussed above, which seek to enrich the fuel/air mixture under condition other than starting and warm-up. Stronger crankcase pulses may be employed for enrichment purposes on starting than could be done in prior art devices, which also seek to enrich the fuel/air mixture under various running conditions. Thus, prior art devices had to be employed in combination with conventional choke systems for starting.

The invention claimed is:

1. A diaphragm-controlled carburetor which includes a diaphragm positioned in a diaphragm chamber to divide said chamber into wet and dry sides, valve means positioned in said wet chamber side and responsive to said diaphragm for feeding fuel to fuel jets, passage means for connecting said dry chamber side to the crankcase of an engine on which said carburetor is mounted, and a valve for controlling opening and closing of said passage means, characterized in that said valve comprises:

means forming a first orifice and a second orifice smaller than said first orifice, and a valve element manually positionable by an engine operator for selectively and alternately connecting said first and second orifices in said passage means, said first orifice being dimensioned to feed crankcase pulses at first intensity to said dry chamber side for delivering an enriching fuel supply to said jets, said second orifice being dimensioned to feed crankcase pulses at second intensity less than said first intensity to said dry chamber side for delivering fuel at lesser enrichment levels to said jets.

2. The carburetor set forth in claim 1 further comprising means venting said dry chamber side to atmosphere.

3. The carburetor set forth in claim 2 wherein said passage means includes a check valve and an orifice separate from said first and second orifices for modulating crankcase pulses to said dry chamber side.

4. The carburetor set forth in claim 3 wherein said valve element comprises a three-position valve element having a first position connecting said first orifice in said passage means, a second position connecting said second orifice in said passage means, and a third position blocking said passage means.

5. The carburetor set fort in claim 4 wherein said valve comprises a third orifice, and wherein said valve element comprises a rotating valve element for selectively connecting said third orifice in series with one of said first and second orifices in said passage means.

6. The carburetor set forth in claim 5 wherein said valve element comprises a disc having a J-shaped slot, said slot connecting said first and third orifices in series in a first position of said disc, and connecting said second and third orifices in series in a second position said disc.

7. The carburetor set forth in claim 1 wherein said valve comprises a third orifice, and wherein said valve element comprises a rotating valve element for selectively connecting said third orifice in series with one of said first and second orifices in said passage means.

8. The carburetor set forth in claim 7 wherein said valve element comprises a disc having a J-shaped slot, said slot connecting said first and third orifices in series in a first position of said disc, and connecting said second and third orifices in series in a second position said disc.

9. The carburetor set forth in claim 8 wherein said valve element comprises a three position valve element having a third position blocking said passage means.

10. The carburetor set forth in claim 9 further comprising means for engaging said valve element to define discretely each of said first, second and third positions.

* * * * *